US007376839B2

(12) United States Patent
Carta et al.

(10) Patent No.: US 7,376,839 B2
(45) Date of Patent: May 20, 2008

(54) SMART CARD ACCESS CONTROL SYSTEM

(75) Inventors: David R. Carta, Poway, CA (US); Guy M. Kelly, La Jolla, CA (US); Joseph V J Ravenis, II, San Diego, CA (US)

(73) Assignee: Cubic Corporation, San Diego, CA (US)

( * ) Notice: Subject to any disclaimer, the term of this patent is extended or adjusted under 35 U.S.C. 154(b) by 823 days.

(21) Appl. No.: 10/141,575

(22) Filed: May 6, 2002

(65) Prior Publication Data

US 2003/0028814 A1 Feb. 6, 2003

Related U.S. Application Data

(60) Provisional application No. 60/289,039, filed on May 4, 2001, provisional application No. 60/318,385, filed on Sep. 10, 2001.

(51) Int. Cl.
*H04K 1/00* (2006.01)

(52) U.S. Cl. ..... 713/185; 713/186; 726/2; 726/9; 726/20

(58) Field of Classification Search ..... 382/115; 726/3, 2, 9, 20; 380/25, 24; 713/185–186; 235/384; 705/65–67
See application file for complete search history.

(56) References Cited

U.S. PATENT DOCUMENTS 4,245,213 A 1/1981 Kriger (Continued)

FOREIGN PATENT DOCUMENTS

EP 0392411 10/1990

(Continued)

OTHER PUBLICATIONS

"Access control for Today's Word", <http://www.securakey.com/docs/company.html>.

(Continued)

*Primary Examiner*—Kim Y. Vu
*Assistant Examiner*—Baotran N To

(74) *Attorney, Agent, or Firm*—Townsend and Townsend and Crew LLP

(57) ABSTRACT

An access control system securely transfers identification and transaction information between an access reader and a contactless smart card over a contactless radio frequency link via an RF modem. The access reader contains a programmable microcontroller, DC/DC converter, regulator, Opto-Isolators and LEDS, and an RF modem. The smart cards contain identification or transaction data as well as reader programming and de-programming software, which is protected by appropriate security keys. An access reader having the appropriate security keys performs a one to one verification of data stored in the smart card to data from an identification device coupled to the access reader. Upon verification of the validity of the smart card, the access reader transfers identification and transaction information over a data link to any external processor or controller which controls access to a secured area. Both the data format/protocol and operating state out of the access reader is programmable and configurable at any time. The access reader and access cards are compatible with any existing Wiegand, magnetic stripe, and serial based access control systems, and are configurable to emerging Biometric system designs.

21 Claims, 5 Drawing Sheets

U.S. PATENT DOCUMENTS

| | | | | |
|---|---|---|---|---|
| 4,288,783 | A | | 9/1981 | Chauvat et al. |
| 4,396,914 | A | | 8/1983 | Aston |
| 4,415,893 | A | | 11/1983 | Roland et al. |
| 4,534,194 | A | | 8/1985 | Aydin |
| 4,634,846 | A | | 1/1987 | Harvey et al. |
| 4,644,484 | A | | 2/1987 | Flynn et al. |
| 4,712,398 | A | | 12/1987 | Clarkson et al. |
| 4,755,799 | A | | 7/1988 | Romano |
| 4,789,859 | A | | 12/1988 | Clarkson et al. |
| 4,902,882 | A | | 2/1990 | Lavelle |
| RE33,873 | E | | 4/1992 | Romano |
| 5,198,643 | A | | 3/1993 | Miron et al. |
| 5,245,329 | A | | 9/1993 | Gokcebay |
| 5,259,025 | A | | 11/1993 | Monroe et al. |
| 5,319,362 | A | | 6/1994 | Hyatt, Jr. |
| 5,337,043 | A | | 8/1994 | Gokcebay |
| 5,418,525 | A | | 5/1995 | Frei et al. |
| 5,457,747 | A | | 10/1995 | Drexler et al. |
| 5,467,082 | A | | 11/1995 | Sanderson |
| 5,477,041 | A | | 12/1995 | Miron et al. |
| 5,502,765 | A | * | 3/1996 | Ishiguro et al. ..... 705/67 |
| 5,526,428 | A | * | 6/1996 | Arnold ..... 713/159 |
| 5,602,536 | A | | 2/1997 | Henderson et al. |
| 5,608,387 | A | | 3/1997 | Davies |
| 5,679,945 | A | | 10/1997 | Renner et al. |
| 5,815,084 | A | | 9/1998 | Lavelle et al. |
| 5,907,149 | A | | 5/1999 | Marckini |
| 5,943,624 | A | * | 8/1999 | Fox et al. ..... 455/556.1 |
| 5,979,754 | A | | 11/1999 | Martin et al. |
| 5,986,564 | A | | 11/1999 | Fraser |
| 6,000,609 | A | | 12/1999 | Gokcebay et al. |
| 6,003,014 | A | | 12/1999 | Lee et al. |
| 6,018,717 | A | | 1/2000 | Lee et al. |
| 6,041,412 | A | * | 3/2000 | Timson et al. ..... 726/3 |
| 6,084,967 | A | * | 7/2000 | Kennedy et al. ..... 380/247 |
| 6,085,976 | A | | 7/2000 | Sehr |
| 6,112,991 | A | | 9/2000 | Klug |
| 6,119,940 | A | | 9/2000 | Klug |
| 6,213,403 | B1 | | 4/2001 | Bates, III |
| 6,219,439 | B1 | * | 4/2001 | Burger ..... 382/115 |
| 6,223,984 | B1 | | 5/2001 | Renner et al. |
| 7,007,298 | B1 | * | 2/2006 | Shinzaki et al. ..... 726/3 |

FOREIGN PATENT DOCUMENTS

| | | |
|---|---|---|
| EP | 0757337 | 2/1997 |
| EP | 0924655 | 6/1999 |
| EP | 1028396 | 8/2000 |
| WO | WO 94/01645 | 1/1994 |

OTHER PUBLICATIONS

"Access Control for Your Business" <http://www.comlock.com/access-commerical.html>.
"Associated Engineered Systems, Inc.—Access Control Systems", <http://www.aesstl.com/accont.html>.
"Electronic Access Control Systems" <http://www.securitydesk.net/eacs/html>.
"IBC Smart Card 814" <http://interbar.com/sc814.html>.
Intelligent Control Systems Co., Ltd. (Access Control System) <http://www.ics.co.th/ACCESS/EL1200.html>.
Keyless Door Access Control System from Mac-Gray, <http://www.dooraccess.com/...>.
"MAG5 Series Access Control", <http://www.wemal.com/mag5.html>.
"Maxking—Smart card System Design", <http://maxking.com/carsysdesign.html>.
"1Card Access Control", <http://www.1card.com/1card/security.html>.
"Security Dealer—School Security" <http://www.secdealer.com/current.safetyfirst.html>.
"Simon '98—Press Release", <http://www.simon-net.com/asp/PressRelease.asp?ID=2306...>.
"Smart Card Market Ready to Explode", <http://www.fcw.com/fcw/articles/1999/FCW_080299_906.asp>.
"Welcome to Security eShow Daily! Access Control", <http://www.eshowdaily.com/security/access/1.html>.

* cited by examiner

SMART CARD ACCESS CONTROL SYSTEM

CROSS-REFERENCES TO RELATED APPLICATIONS

This application claims the benefit of priority under 35 U.S.C. 119(e) to Provisional U.S. Patent Application No. 60/289,039 filed May 4, 2001 and Provisional U.S. Patent Application No. 60/318,385 filed Sep. 10, 2001 which are incorporated herein by reference in their entirety.

BACKGROUND OF THE INVENTION

1. Field of Invention

This invention relates generally to access systems for accessing restricted areas, and more specifically to a one to one comparison access card reader utilizing security keys for true authenticated verification of the identity of an access card holder attempting to gain access to a restricted area.

2. Background

Access readers typically are small boxes located proximate to the entrances to restricted, or secured, areas. To gain access to an area, an access card holder must present an access card to the access reader, which in turn verifies the information on the card with a central computer. Commonly used access cards include both contact and contactless smart cards. In the prior art systems, the central computer stores data files associated with each access card holder, including information regarding employee identification, card validity, and access rules. The verification process of the prior art requires an initial communication between the access card and the access card reader, communication between the access reader and the central computer, verification of card holder data and access card data at the central computer, communication of the results from the central computer to the access reader, and communication of the results to the access card holder by allowing or denying access to the restricted area.

The verification process of the prior art is sufficient for low traffic entrances, such as a gated entrances for a small office building, wherein the additional time required for the verification process does not cause long queues of employees waiting to pass through the gate. However, even a slight delay required to swipe a contact card and to verify card holder data at the central computer may be inconvenient for "high traffic" entrance ways. Further, complex comparisons such as biometric identification, requires a complex decision process and associated software that must be performed by the central computer as the currently available access readers and access cards have limited storage capacity and processing capability. In addition, the central computer must have updated information for each person, including infrequent visitors, who have clearance to enter a secured area. The data bases stored at the central computer for these entrance ways have the potential to be unmanageable, particularly for multi-story, multi-company office buildings. Security necessarily is augmented through use of security personnel stationed at the gates to check and/or verify identification of employees as they enter the gates.

Installations of the prior art access control systems are costly. Each new access gate or entrance way requires installation of communication lines to the central computer. For multi-story or expansive buildings, the wiring and/or re-wiring process is both time-consuming and expensive. These factors often present cost-prohibitive blocks to converting rooms, labs, or designated areas into secured access areas. In addition, because each door or gate may have different access rights, the central computer also must keep track of personnel access rights for every door or gate. Installation of a new gated entrance requires update of the central computer data bases. In addition, each change in personnel or a change in personnel access to restricted areas requires an update to the data bases, and for large companies, the changes may be required daily.

The prior art also presents security issues. For example, an access card holder user can enter a secured area with an unreported stolen card if the verification process is for validity of the card, only. Thus, for security purposes, entrance ways are often manned to verify the identity of a person holding the card with a picture identification on the access card. One way to eliminate the requirement of security personnel at each entrance way, is through the use of automatic identification systems connected to the central computer. Biometric systems such as fingerprint identification systems are becoming increasingly popular as the biometric technology develops to further identify an access card holder as he or she passes through the secured entrance way. Although the biometric systems may add security of verification and eliminate additional security personnel, the central computer is further burdened with storage of the biometric information. Biometric systems typically employ the concept of a "one to many" comparison, that is, an access card holder presents his fingertip for fingerprint imaging, and this one image is transmitted to a central computer for comparison to many fingerprints to find a matching print. The comparison and search time further slows down the identification process to add delays to the time required to pass through a secure entrance way.

Therefore, a need remains for an access control system that does not require connection to a central computer, but which provides verification of the validity of the access card as well as identification of the access card holder. A further need remains for access readers and access cards that have expanded storage and processing capability for performing complex decision processes and comparisons, such as biometric identification. Yet a further need remains for an access control system which minimizes installation time and cost, which is compatible with existing access control systems, and which may be updated to accommodate changes in secure area entrance rules and locations.

SUMMARY OF THE INVENTION

It is an advantage of the present invention to provide an access control system that does not require communication to a central computer for activation, access card verification, and reconfiguration.

It is another advantage to provide an access control system which employs a one to one verification process at the access card reader and does not require data storage for every access card holder.

Still another advantage is to provide an access control system that may be configured to emulate a variety of access cards to allow compatibility with existing access systems.

It is yet another advantage to provide an access control system which may be configured to allow different access rights to a variety of gated entrances.

A further advantage is to provide an access control system having the option for an unattended or attended secured entrance way.

In an exemplary embodiment of the present invention an access control system includes a access reader having an RF interface for communication with a contactless smart card, at least one serial connection to an identification (ID) device, and data output lines for controlling access to a secured entrance. The contactless smart card includes memory divided into a number of blocks, wherein each block is further divided into pages of a predetermined number of bytes. At least one page of each block is utilized to store an application type number key, a read key, and a write key. The access reader communicates with the smart card providing the access reader is supplied with the keys of at least one memory bock of the smart card. The use of keys provides an authenticated read of data from the access card that is not provided in prior art access control systems.

The access control system of the exemplary embodiment of the present invention utilizes four types of contactless smart cards including activation cards, access cards, deactivation cards, and update cards. In an exemplary embodiment of the invention, the access readers are pre-programmed during manufacture with an initial activation key. The access readers may then be initialized by reading data from an activation card encoded with the same key. The deactivation card returns the access reader to a production state awaiting an activation card. Modifications in access reader data, such as keys, are downloaded to the access reader utilizing an update card. In one embodiment of the invention, the access reader includes a serial port for connection with a personal computer (PC) device. The PC device may be used for initializing or updating the access reader, or for collecting transaction, or "log" , data from the access reader.

Access cards are presented to the access readers to gain entrance to secured areas. The access cards are further formatted to contain application specific data in a designated memory blocks. Each memory block has an application type number key, a read key, and a write key. The application specific data is the data required by the access reader to verify the identity of the access card holder against data received from an identification device. Identification devices of the exemplary embodiment, such as keypads and biometric identification devices, may vary according to the use of the access reader. The access reader includes a microprocessor for comparing the application specific data from the access card with the data received from the identification device. Upon verification of a match of the data, the access reader permits the access card holder to enter the secured area.

The access reader of an exemplary embodiment of the present invention receives identification data from biometric devices for comparison to identification data contained on the access cards. The biometric devices provide biometric images, e.g., fingerprint images, retinal images, and/or facial images, as well as template minutia of the actual images. The template minutia may be used by an access reader for automatic comparison of the template minutia from the biometric device with the template minutia stored on an access card. The actual images from the access card and the biometric device may be used by security personnel to make decisions whether to permit an access card holder access to the secured area. Thus, the access control system of the exemplary embodiment provides means for both attended and unattended identification verification.

The access reader of the exemplary embodiment may be integrated with existing access control systems by programming the access reader to output a data stream required by the existing system upon verification of the identification data from an ID device with the application data from the access card. For example, access control systems that utilize key pads and swipe cards, and which output Wiegand bit streams, may be updated by providing access readers that output the same Wiegand bit streams upon a positive comparison of the key pad entries to the entries stored on the contactless access card. The access reader may be configured to be compatible with other existing access readers, such as magnetic stripe and serial based access control systems in the same manner. The ability to integrate the access reader of the exemplary embodiment with existing systems, enables the existing system to be updated for contactless smart card operation without a shut down of the exiting system.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

Figure 5:
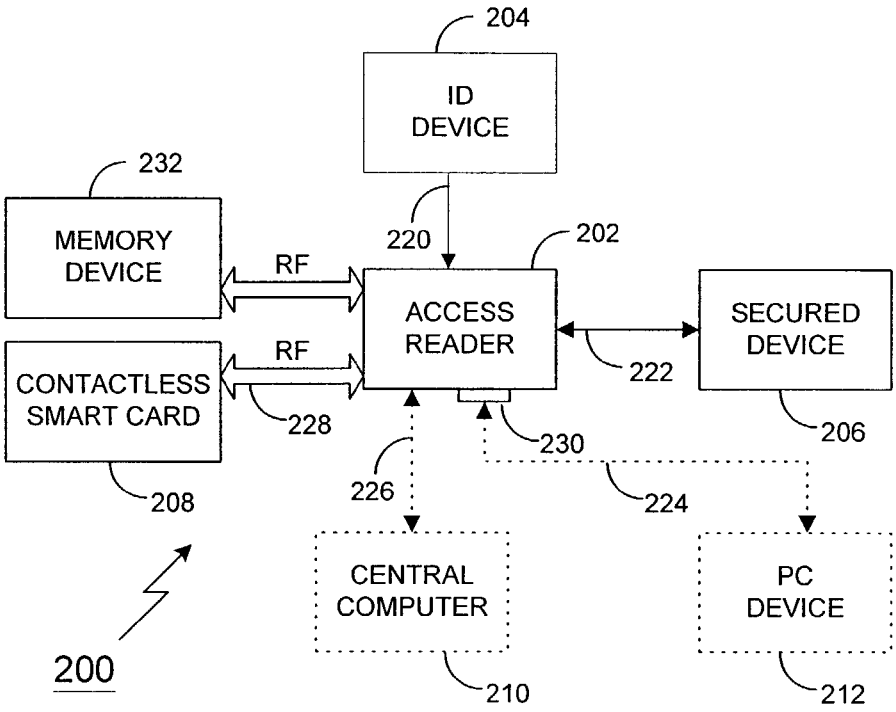
FIG. 5 is an illustration of an access control system of a preferred embodiment.

FIG. 5 illustrates the smart card access control system 200 of a preferred embodiment of the present invention. The system 200 includes an access control unit (ACU), also referred to as an access reader 202, which communicates by radio frequency 228 to an access card, e.g., a contactless smart card 208. The access reader may be used for basic applications such as transit access, loyalty transactions, and health care benefits which utilizes a contactless smart card. However, this basic system has minimum use as the access reader 202 is limited to verifying the validity of the smart card 208 rather than further identifying the access card holder. Thus, the access control system 200 of the preferred embodiment further includes an identification device 204, such as a keypad or a biometric device. A biometric device includes, e.g., a camera and processor for facial or retinal recognition, or a fingerprint pad and processor for fingerprint identification. In other embodiments of the invention, the identification device 204 can be incorporated into the access reader 202. The output data 220 from the identification device 204 is sent to the access reader 220 which performs a one-to-one (1:1) comparison of the output data 220 with card data read from the access card 208. A positive verification may be indicated by the illumination of an indicator and/or by the output of a control signal 222 to a secured device 206 such as a door lock or a gate turnstile.

Figure 2:
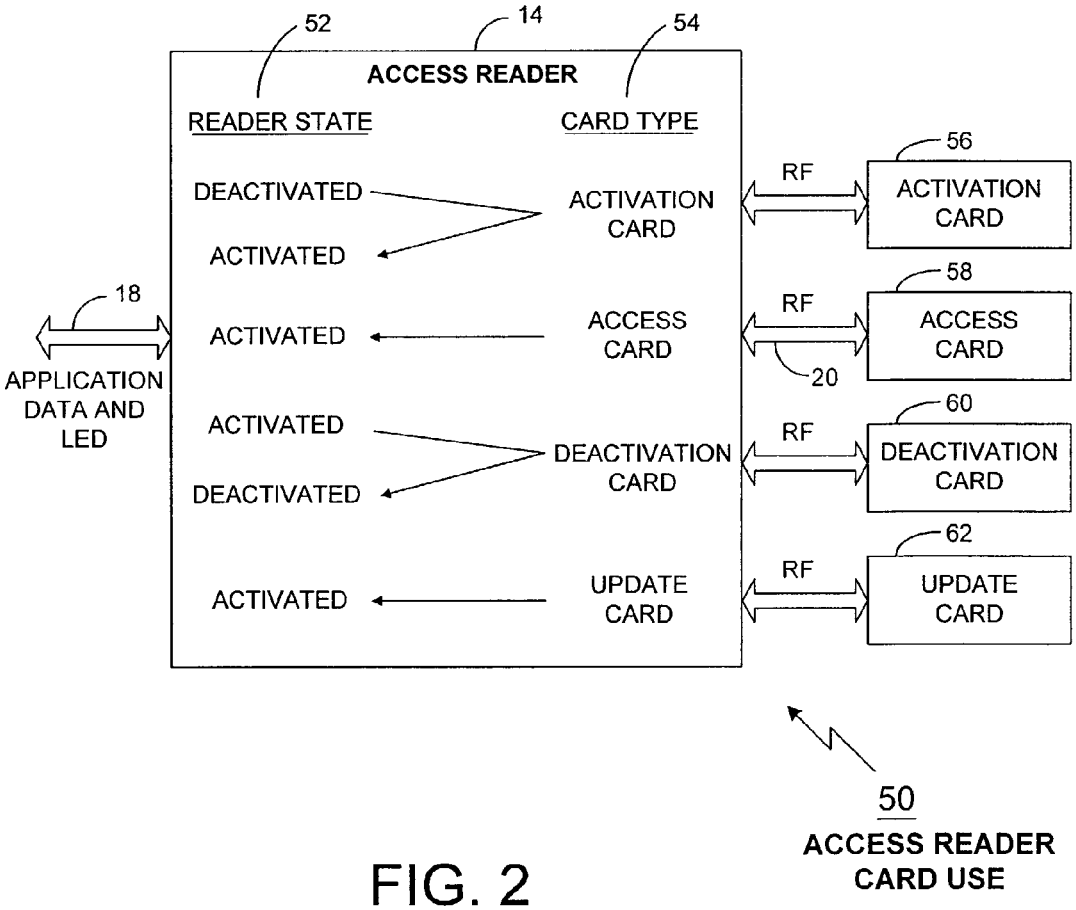
FIG. 2 is a block diagram of the access reader states and card types of the preferred embodiment.

Continuing with FIG. 5, the access reader 202 of a preferred embodiment may include a serial port 230 for connection with a personal computer-type (PC) device 212. The PC device 212 may be utilized with the access reader 202 to program standard production smart cards 208. The programmed smart cards 208, then are utilized to program an access reader 202 for a desired mode of operation. The PC device 212, or a contactless update card 62, as shown in FIG. 2, may be used to download database material to the access reader 202. Similarly, the PC device 212 or a contactless memory device 232 may be utilized to upload log lists from the access reader 202. Log lists may include data collected from access cards 208 that are presented to the access reader 202, as well as data identifying the access reader 230. The access reader 202 of the preferred embodiment is connected via another serial connection 226 to a central computer 210. The access reader 202 performs the access identification process in real time, and uploads the results of the "transactions" to the central computer at a later time, for example, each night after a business day.

Figure 3:
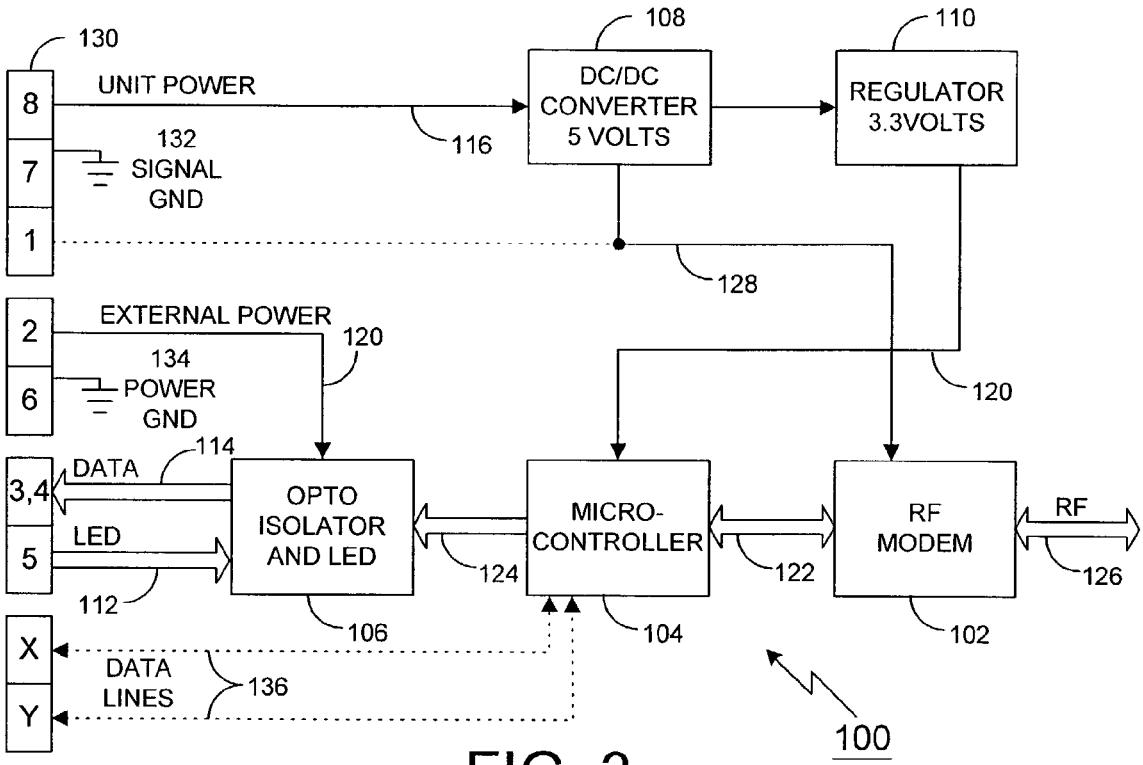
FIG. 3 is an illustration of the components of an access reader of a first embodiment of the present invention.

FIG. 3 illustrates the electrical hardware components of an access reader 100 of a preferred embodiment of the present invention. The access reader 100 includes a microcontroller 104 for performing the access verification processes, and an RF modem 102 for communicating with a contactless smart card. Unit power 116 is connected to a DC to DC converter 108 which supplies 5 volts internal power 128 to the RF modem 102. The DC to DC converter 108 is connected to a regulator 110 which supplies power 120 to the microcontroller 104. The RF modem 102 of the preferred embodiment generates a 13.56 MHZ RF field 126, and reads standard smart cards at distances up to 10 cm. The microcontroller 104 outputs data signals 124 for controlling the secured device 206, as shown in FIG. 5, for illuminating an indicator, such as an LED 112, or for communicating with the central computer 210 or the PC device 212. The microcontroller 104 includes memory for storing data such as software applications for validation processes, and negative lists of invalid access cards. Additional input data lines 136 may be required to communicate with multiple identification devices 204 or with an existing access control system reader.

Continuing with FIG. 3, in one embodiment of the present invention, the access reader 100 includes an opto-isolater 106 for isolating the microcontroller 104 from the unit power 116 and the internal power 118. A terminal block 130 of the preferred embodiment utilizes at least eight connections as shown in Table 1. Additional connectors/terminals X, Y, etc. may be necessary for data communications to existing devices (not shown) and external devices 204, 206, 212, 210, as shown in FIG. 5. If the microcontroller 104 does not require optical isolation, the unit power 116 and the external power 120 may be provided from the same power source by connecting terminals 2 and 8, and by connecting terminals 6 and 7, for the terminal block 130 configuration shown in FIG. 3. This configuration uses the external power 120 for the optical isolator and the LED 106, but defeats the optical isolation by connecting the signal ground 132 to the power ground 134.

As shown in Table 1 for one embodiment of the access reader 100, terminals 3 and 4 are data outputs. Other embodiments of the invention may require more or fewer data outputs. For example, if the access reader 100 is programmed by activation card to output Wiegand data, the data appears on terminals 3 and 4. If the unit is programmed to output serial or magnetic-stripe data the data appears on pin 3, only.

TABLE 1

Terminal Block Connections for an Access Reader

| Terminal | Function | Comment |
|---|---|---|
| 1 | Internal 5 Volts; or Test Terminal | Provides +5 Volts at up to 100 mA; or for production testing |
| 2 | External 5 to 28 Volts | Isolator and LED power (Requires +5 to +28 Volts at 20 mA) |
| 3 | Data 1 | Optically isolated data out |
| 4 | Data 0 | Optically isolated data out |
| 5 | LED | High = Red, low = Green, unconnected = Yellow |
| 6 | External Common | Isolator and LED power and data signal common |
| 7 | Power Common | Unit power and internal +5 Volt common |
| 8 | Unit Power | Requires from +8 to +28 Volts at up to 2.5 Watts |

Figure 4:
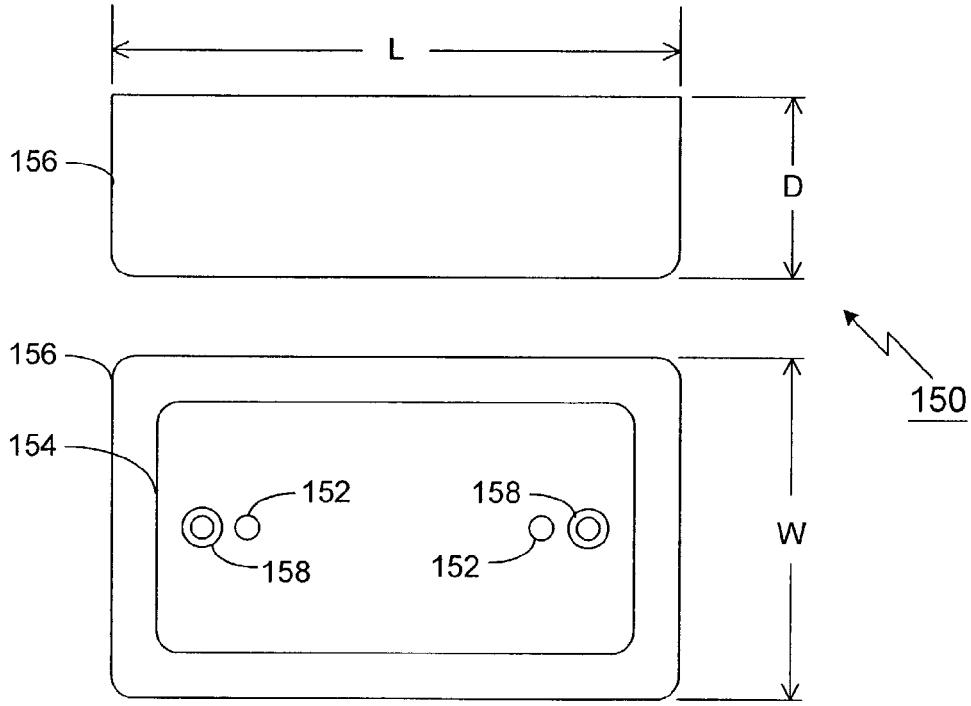
FIG. 4 is an illustration of a preferred physical configuration of an access reader.

FIG. 4 illustrates a packaging configuration 150 for the electrical components of the access reader 100 of FIG. 3. The packaged access reader 150 of a preferred embodiment of the invention utilizes the same area footprint as a single-gang wall plate having a width, W, of 2.75 inches (6.98 cm) and a length, L, of 4.5 inches (11.43 cm). The packaged access reader 150 is mounted onto a surface using two mounting holes 158 that match the holes in a single-gang electrical utility box. Another embodiment of the packaged access reader 150 replaces or fits inside the electrical utility box. The packaged access reader 150 of the preferred embodiment has a depth, D, of 1.5 inches (3.81 cm), be configured for any necessary thickness. The packaged access reader 150 has a faceplate area 154 which provides a target for the presentation of an access card. At least one LED 152 on the faceplate 154 illuminates to red to signal an invalid card or a read error. A valid card and a successful identification of the access card holder is indicated by the LED 152 illuminating to green. The LED 152 provides the access card holder with an indication that the access reader 100 is operational. In other embodiments, the packaging configuration be of any form factor desired by a customer.

Figure 6:
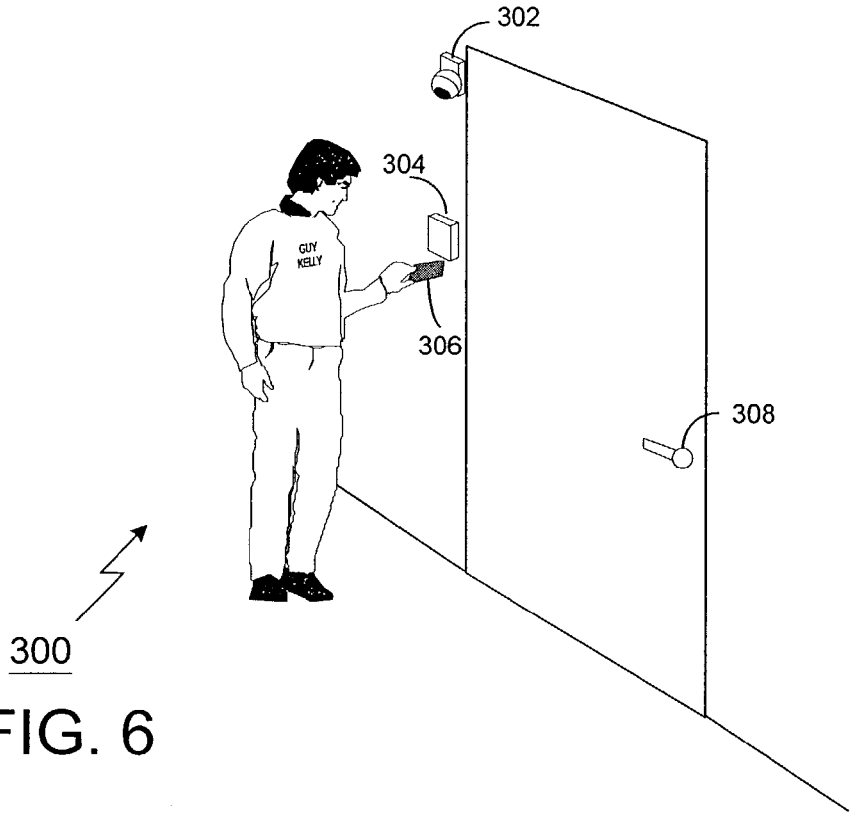
FIG. 6 is an illustration of a biometric access control system of a preferred embodiment.

FIG. 6 illustrates a biometric configuration 300 of one embodiment of the invention. The access card reader 304 is installed adjacent a door and controls the door reader 308. An access card holder presents his access card 306 to the access card reader 304, which reads pre-stored access data from the access card 306. In this configuration 300, a camera 302 sends an image and/or image minutia of the access card holder to the access card reader 304. The access card reader 304 compares the data from the camera 302 with the pre-stored access data on the access card 306 to verify identification of the access card holder. If the image data matches the pre-stored access data, then the identification of the access card holder may be guaranteed to a higher degree than existing control systems that verify one data component, only. This validation is a one to one comparison, and does not require communication with a data base of a central computer.

To prevent security breaches, the access card reader 304 of the preferred embodiment performs additional verifications before or after the identification process. For example, the access card reader 304 must first establish communication with the access card 306 utilizing specific protocols. The communication protocols may also identify particular information about the access card 306, such as the serial number of the access card 306. If the access card 306 does not respond to the required communication protocols transmitted by the access reader 304, then the access card 306 is not valid for that particular entrance way 308. Once communication is established between the access card 306 and the access reader 304, the access reader 304 can read data from the access card 306 only if it knows at least one application key and read key stored on the access card 306. In an alternate embodiment, the access card reader 304 further compares the access card information, such as the serial number, with access card holder data, such as negative lists, that are downloaded to the access reader 304 at regular intervals by means of the PC Device 212, the central computer 210, or an update card 62 as illustrated in FIG. 5. If any of the validation processes have a negative result, the access card reader 304 denies access to the secured area.

In an alternate embodiment of the invention, the access card reader 304 may also write an invalidation code to the access card 306 providing the access card reader 304 has a correct write key. The invalidation code on the smart card may be recognized by all or specific access readers. Access readers that recognize the invalidation code may then deny access to corresponding secured areas until the access card 306 is re-validated by security personnel.

For additional security, it is possible to require the access card holder to present the access card 306 before exiting the same, or another, entrance. Because the identification of the access card holder and the validity of the access card 306 is determined by the access card reader 304 immediately upon presentation of the access card 306, the access card holder may gain entrance into a secured area using an access card 306 that is invalid. However, a further validation may be performed for access card readers 202 that are connected to a central computer 210, as shown in FIG. 5. The transaction log data, including, for example, the access card serial number and time of entrance is uploaded to the central computer 210 or a memory device 232 at regular intervals and/or after a pre-determined number of identification verifications. The central computer performs a validity check of the transaction data for each access card 208 against data stored in the central computer. If the card is determined to be invalid, the central computer 210 then downloads updated information to the access readers 202 of the secured area to deny exit for the access card holder, and alerts security. The preferred embodiment of the access reader 202 also includes an additional security measure for notifying security personnel of an attempted removal of the access reader 202. For example, upon the detection of a loss of power, the access reader 202 sends an identifying signal to the central computer 210.

Figure 1:
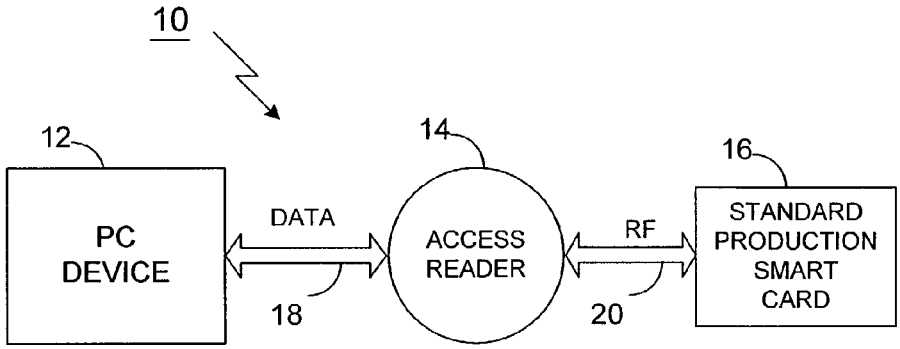
FIG. 1 is an illustration of the initialization components for a smart card access control system of a preferred embodiment.

FIG. 1 illustrates the initialization components 10 for the smart card access control system of a preferred embodiment. The components 10 include an access reader 14, a standard production smart card 16, and a personal computer device 12. The access reader 14 includes a serial port for data communication 18 between the access reader 14 and the PC device 12, e.g., a laptop or hand held computer device. In an alternate embodiment of the invention, a central computer, as shown in FIG. 5, that is hardwired to the access reader 14 may perform the installation and configuration processes of the PC device 12. Continuing with FIG. 1, the PC device 12 together with the access reader 14 are utilized to create various card types 54 from standard production smart cards 16. FIG. 2 illustrates the access reader states 52 and card types 54 of the preferred embodiment. The different card types 54 are used with the access reader 14 for activation, access, deactivation, and update purposes.

Continuing with FIG. 2, the access reader 14 has two operational reader states 52 which are the deactivated operational state and the activated operational state. Upon power-up, the access reader 14 of the preferred embodiment indicates its operational state by, for example, beeping three times to indicate that it is in the deactivated operational state. In the deactivated operational state, the access reader 14 waits for an activation card 56 to lock it into the activated state. When a valid activation card 56 is presented to the access reader 14, the access reader 14 is locked into the activated operational state using the application type number, the read key, and output format specified by the activation card 56. If a production smart card 16 is presented to the access reader 14 while the reader is in the deactivated operational state 52, and the smart card is not a valid activation card 56, the access reader 14 will signal an error condition, e.g., two beeps.

The activated operational state of the access reader 14 utilizes customer specific application type keys which are pre-loaded into the access reader 14. Upon power-up, the access reader 14 of the preferred embodiment indicates that it is in an activated operational state by, for example, beeping once for a duration of one second. Table 2 lists the actions that an access reader 14 of the preferred embodiment takes upon presentation/detection of an access card 16. In the activated operational state, the access reader 14 only reads access cards 58 that are encoded by a customer with an appropriate read key in order to prevent unauthorized cards from communicating data to the access reader 14 In the preferred embodiment, the read key of the access card 58 is encrypted to produce a hash key. The access reader 14 reads the hash key and uses the encryption code to determine whether the read key of the access card 58 is valid. The use of the read/hash key provides an authenticated security which is not found in current access systems. Other systems which provide un-authenticated Wiegand identification numbers can easily be replicated via playback attack.

As shown in Table 2, if the read key is invalid, the access reader 14 beeps twice to indicate the invalidity of the access card 58 and no data is output to control access to the secured area. In the preferred embodiment, the serial card number or any other identifying data of the invalid access card 58, if available, is stored in a log file in the access reader for subsequent uploading to a PC device 212, a central computer 212, or contactless memory device 232. The information them may be utilized to perform actions such as alerting security or placing the access card 212 on a negative list. If the read key stored in the access reader 14 is correct, the access reader 14 can attempt to read data from the access card 58. If data is not available, the access reader 14 signals access card 58 invalidity by beeping twice. If data is available, the access reader 14 performs a cyclic redundancy check (CRC) on the data to determine whether parity is correct. If all three conditions are met, then the access card 58 is valid and the access reader 14 outputs formatted data to perform actions to allow the access card holder to gain access to the secured area. Security may be increased by maintaining the secrecy of the hash key and/or the CRC.

TABLE 2

Access Reader Actions for an Activated State

| | Correct | Data | Valid | Access Reader Action | |
|---|---|---|---|---|---|
| | Read Key | Read | CRC | Beeps | Output |
| 1 | N | N | N | 2 | none |
| 2 | Y | N | N | 2 | none |
| 3 | Y | Y | N | 2 | none |

TABLE 2-continued

| Access Reader Actions for an Activated State | | | | | |
|---|---|---|---|---|---|
| | Correct | Data | Valid | Access Reader Action | |
| | Read Key | Read | CRC | Beeps | Output |
| 4 | Y | Y | Y | 1 | Formatted Data |
| 5 | Other | Reader | Errors | 2 | none |

Figure 8:
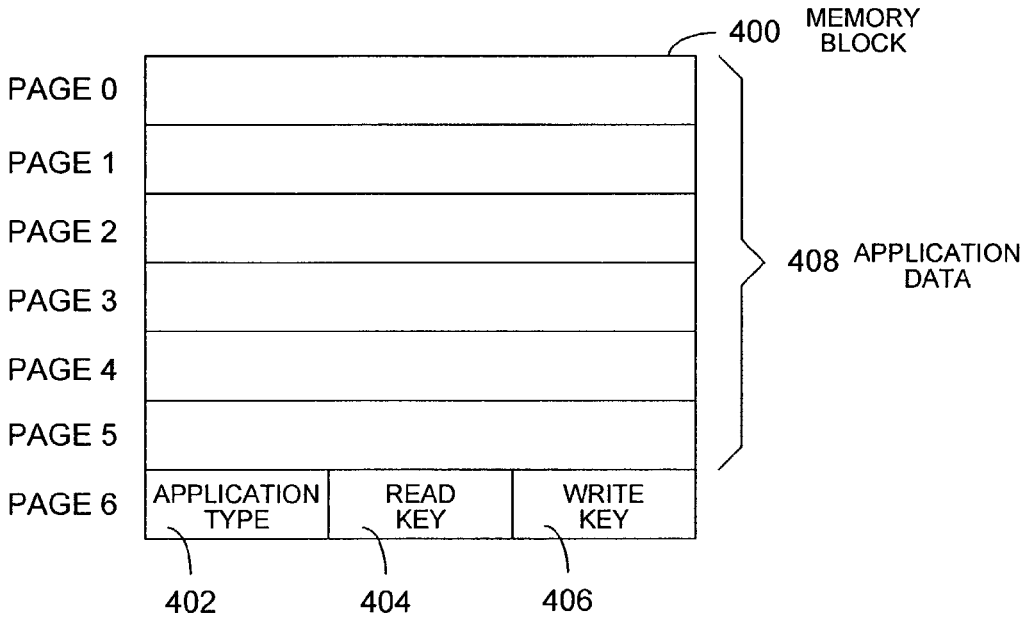
FIG. 8 is an illustration of a memory block of a contactless smart card of the preferred embodiment.

Referring to FIGS. 2 and 5, the access cards 58 of the preferred embodiment are standard production contactless smart cards formatted for use with the access control system 200. If desired, these cards 58 can be securely shared among multiple systems, such as transit system fare-card applications, building physical access control applications,equipment access applications and loyalty applications. The memory in a standard production smart card 208 is divided into blocks. Each block 400, as shown in FIG. 8, contains multiple pages of read/write memory for storage of application data 408, and an associated page for storing a read key 404 and a write key 406. Each block 400 is assigned an application type number (ATN) 402, e.g., transit or access control.

For example, in a standard memory smart card, there are a number of available memory blocks 400. A set of one or more blocks 400 of memory on a smart card 208 used for an application is referred to as a customer memory area (CMA). Each customer memory area can use up to the total number of blocks available on the smart card 208. For access control applications, the customer memory area can vary from 16 bytes for simple identification to up to 32 Kbytes for intensive biometric identification since access reader 202 uses only one application type number 402. and read key 404 from cards that it has been programmed to use. Since each customer memory area uses customer specified read and write cryptographic keys 404, 406 to secure the card, each customer memory area is both secure and inaccessible to anyone, i.e., an access card reader, that does not have the correct cryptographic keys 404, 406.

Figure 7:
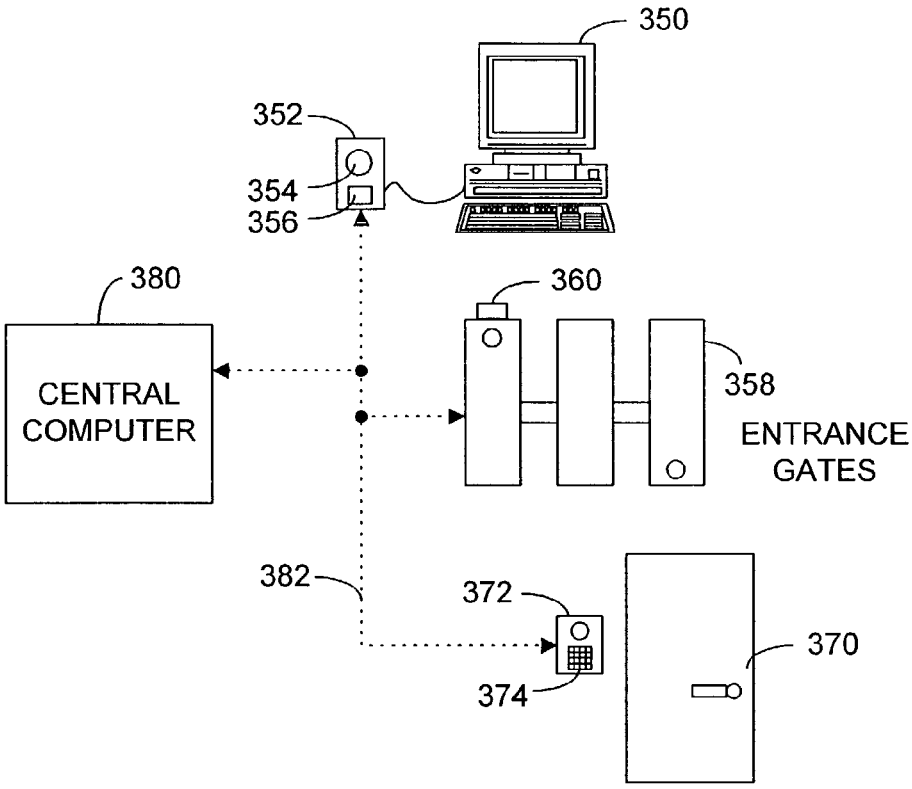
FIG. 7 is an illustration of example equipment that may employ the use of the access control system of a preferred embodiment of the present invention.

Adding access control capabilities to an existing smart card requires at least one application block 400 to be unused and available in the smart card memory. This allows multiple applications, such as transit for subway and buses, loyalty, payment systems, identity, and/or additional physical access control applications, to be loaded seamlessly and securely onto the same contactless smart card. FIG. 7 illustrates example applications of the access control system 200. Each application may be connected 382 to a central computer 380. A first application for physical access control is illustrated as a door 370 controlled by an access reader 372 having a keypad ID device 374. An employee presents his or her access card 58 to the access reader 372 and enters a code on the keypad 374. The code is verified with identification data 408 stored on the smart card to determine the validity of the smart card. In an alternate embodiment of the invention, other identification devices may be used in place of, or in addition to, the key pad 374. For example, in an alternate embodiment of the invention, the access reader 372, 352, 360 may require more than one identification device. In such an embodiment, the smart card application data 408 contains the identification data for comparison with the data received from each identification device. The access control system may also be used to control access to equipment such as personal computers 350. For example, an access reader 352 having an RF interface 354 for reading a smart card, and a fingerprint pad 356 for identifying the access card holder, may be used with security software installed on the personal computer 350 to limit access to the computer 350. The smart card may also contain an application type number 402 that is utilized by access readers 360 at transit gates 358.

Figure 9:
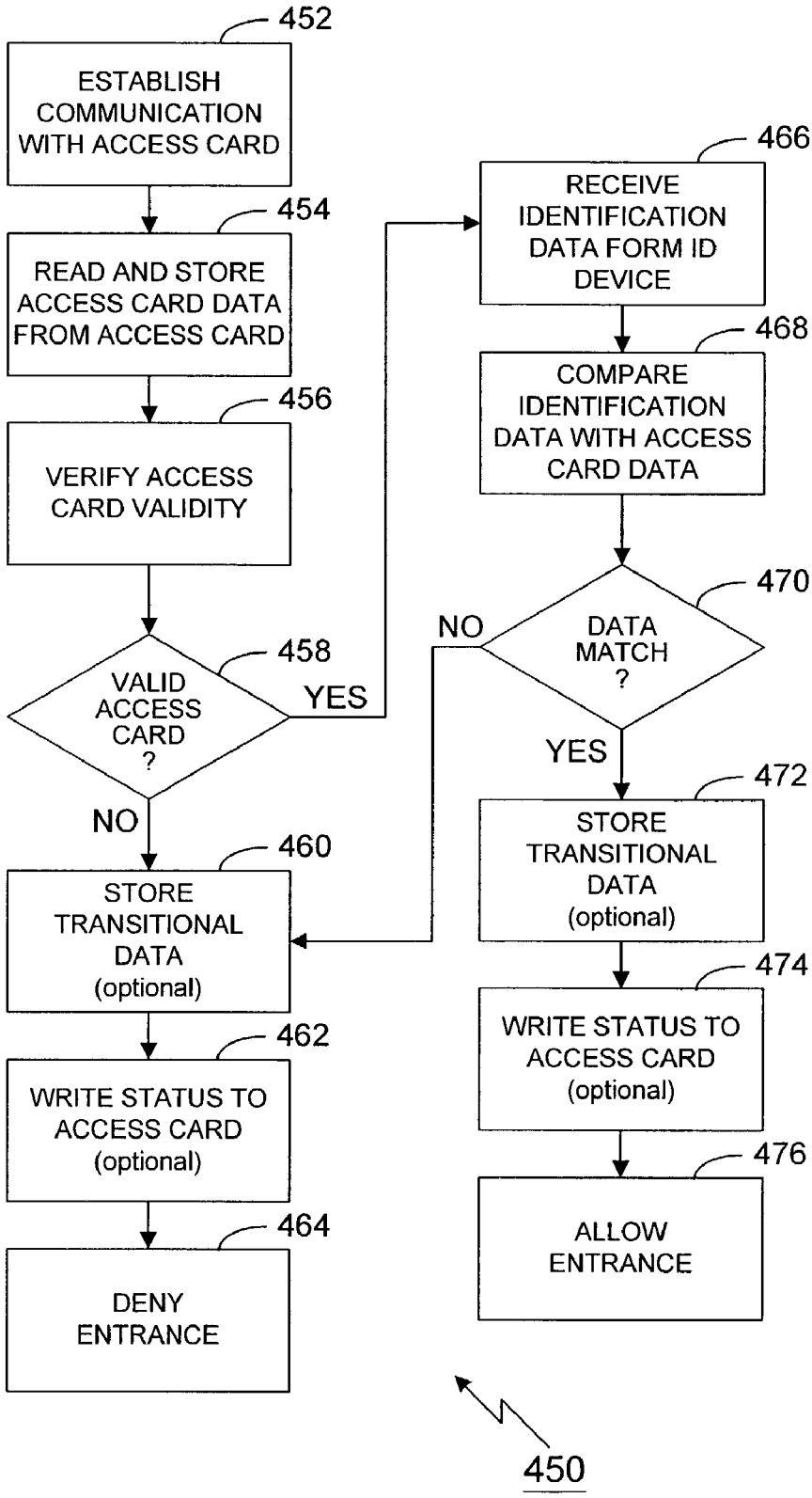
FIG. 9 is a flow diagram of a method of the preferred embodiment for an access control system.

A method for smart card access control 400 is illustrated in FIG. 9, with reference to system components of FIG. 5. In a first step 452, the access reader 202 establishes communication with a smart card 208 configured as an access card. If communication is established successfully, then the smart card 208 has responded to a communication protocol used by the access reader 202. In step 454, the access reader 202 reads and stores access card application data from the access card. The access reader determines whether the access card is valid in step 456. If the access card is invalid, step 458, for example, parity is incorrect or the read keys used by the access reader 202 are invalid, access to the secured area is denied, step 464.

The preferred embodiment of the invention provides the optional steps of recording the access card data in a log file, step 460, and writing an invalid flag to the access card, step 462, providing the access reader 202 knows a required write key for the access card 208. In step 466, the access reader 202 receives identification data from an ID device 204, and compares the application data with the identification data, step 468. A data match in step 470 results in the access reader 202 outputting a signal 222 to a secured device 206 to allow an access card holder access to a secured area. In optional steps 472 and 474, the access reader 202 stores the transaction data to a log file and updates a status on the access card 208.

Although a preferred embodiment of the invention has been described above by way of example only, it will be understood by those skilled in the field that modifications may be made to the disclosed embodiment without departing from the scope of the invention, which is defined by the appended claims.

We claim:

1. A system for providing controlled access to a secured area, the system comprising:

a secured device for allowing access into the secured area upon receiving at least one access control signal;

an identification device for providing identification data corresponding to a biometric measurement by the identification device;

an access card having at least one block of memory comprising:

application data corresponding to biometric data of an access card holder; and at least one application security key comprising an application read key; and an access reader for outputting the at least one access control signal for controlling the secured device, the access reader comprising:

a memory means for storing configuration data and at least one valid security read key;

an RF interface for reading the application data from the access card if the at least one valid security read key is the same as the application read key, the at least one valid security read key providing an authenticated reading of the application data from the access card;

at least one input data line for receiving the identification data from the identification device; and a processor means for comparing the application data to the identification data and for outputting the at least one access control signal upon a match between the application data and the identification data.

2. The system of claim 1, wherein the secured device is a transit gate.

3. The system of claim 1, wherein the secured device allows operation of electronic equipment having a device processor, further comprising:

security software for execution by the device processor, the security software disallowing use of the electronic equipment unless the at least one access control signal is received by the security software.

4. The system of claim 1, wherein the identification device is a biometric device and the identification data is image data.

5. The system of claim 1, wherein the identification device is a biometric device and the identification data comprises template minutia.

6. The system of claim 5, wherein the processor means for comparing the application data is automated.

7. The system of claim 4, wherein the access reader further comprises means for displaying the image data and the application data, the displayed image data and application data for use by a security person for making a decision regarding issuance of the at least one access control signal for allowing access to the secured area.

8. The system of claim 1, wherein the access reader has a plurality of reader states comprising:

an activated state for controlling access to the secured area; and a deactivated state, the deactivated state having an activation key for reading an activation card.

9. The system of claim 1, further comprising an update card for updating the configuration data of the access reader.

10. The system of claim 1, wherein the at least one application security key of the access card further comprises an application write key.

11. The system of claim 10, wherein the memory means of the access reader further stores a valid security write key for writing to the access card if the valid security write key is the same as the application write key.

12. The system of claim 11, wherein the access reader writes an invalid flag to the access card if the application data does not match the identification data.

13. A method of controlling access to a secured area using an access reader, the method comprising the steps of:

receiving identification data corresponding to a biometric measurement of a user of an access card from a biometric device;

reading application data corresponding to biometric data of an access card holder from an access card, comprising the steps of:

transmitting an application read key from the access reader to the access card; and allowing output of the application data from the access card if the transmitted application read key matches a read key stored on the access card;

comparing the application data to the identification data; and outputting at least one access control signal upon a match between the identification data and the application data, the at least one access control signal for allowing access to the secured area.

14. The method of claim 13, wherein the at least one access control signal opens a gated entrance.

15. The method of claim 13, wherein the at least one access control signal allows the use of a processor enable device.

16. The method of claim 13, wherein the step of providing identification data corresponding to an access card holder to the access reader comprises the step of:

producing an image of the access card holder, wherein the image is one of a facial image, a retinal image, and a fingerprint image.

17. The method of claim 13, wherein the step of comparing the application data to the identification data is performed by the access reader.

18. The method of claim 13, wherein the step of comparing the application data to the identification data is performed by a security person.

19. The method of claim 13, further comprising the step of:

writing an invalid flag to the access card upon a mismatch between the identification data and the application data, the invalid flag for at least partially restricting use of the access card.

20. The method of claim 13, further comprising the step of updating configuration data of the access reader using a contactless update card.

21. A system for controlling access to a secured area, the system comprising:

an access card configured to:

store, in memory of the access card, biometric data of an access card holder and an application read key;

prevent output of the biometric data to one or more access devices until a security read key matching the application read key is received; and output the biometric data to the one or more access devices when the security read key matching the application read key is received; and the one or more access devices, communicatively coupled with the access card, and configured to:

read the biometric data from the access card only when the application read key matches the security read key stored in memory of the one or more access devices;

receive identification data corresponding to a biometric measurement associated with a user of the access card;

compare the biometric data with the identification data; and output at least one access control signal to allow the user access to the secured area upon a match between the biometric data and the identification data.

* * * * *